US006832689B2

(12) United States Patent
Cho

(10) Patent No.: US 6,832,689 B2
(45) Date of Patent: Dec. 21, 2004

(54) TOOL BOX HAVING EXPANDABLE DRAWERS

(76) Inventor: Yao-Lin Cho, No. 12, Fudung Rd., Daan Shiang, Taichung (TW)

( * ) Notice: Subject to any disclaimer, the term of this patent is extended or adjusted under 35 U.S.C. 154(b) by 82 days.

(21) Appl. No.: 10/374,975

(22) Filed: Feb. 28, 2003

(65) Prior Publication Data

US 2004/0168941 A1 Sep. 2, 2004

(51) Int. Cl.[7] ..... B65D 85/28
(52) U.S. Cl. ..... 206/743; 206/372; 206/23.88
(58) Field of Search ..... 206/372, 373, 206/503, 506, 743; 43/54.1; 220/23.83, 23.88

(56) References Cited

U.S. PATENT DOCUMENTS 1,667,938 A * 5/1928 Labadie et al. ..... 190/17
2,347,270 A * 4/1944 Larsson ..... 312/244
D153,828 S * 5/1949 Settle ..... D3/284
3,600,840 A * 8/1971 Meyer ..... 43/57.1
4,782,619 A * 11/1988 Richards ..... 43/54.1
5,611,170 A * 3/1997 McGuff et al. ..... 43/57.1

* cited by examiner

*Primary Examiner*—Jacob K. Ackun, Jr.

(57) ABSTRACT

A tool box includes a base and two sets of boxes are located symmetrically above the base and each set of boxes is pivotably connected to the base by a set of links. Each set of links includes a long link and two short links which are located on two sides of the long link. The long link is pivotably connected the base and the two boxes at three pivot points. One of the short links is pivotably connected between the base and the box rested on the base, and the other short link is pivotably connected between the two boxes. The two sets of boxes can be expanded outward relative to the base when either one of which is pulled outward.

2 Claims, 5 Drawing Sheets

TOOL BOX HAVING EXPANDABLE DRAWERS

FIELD OF THE INVENTION

The present invention relates to a tool box having a plurality of boxes which are connected by links and symmetrically located on a base so that the boxes can be expandable simultaneously.

BACKGROUND OF THE INVENTION

A conventional tool box generally includes a base and a cover which is pivotably connected to the base. The cover can be opened from the base and tools and accessories are received in the base and the cover. In order to accommodate more parts in one tool box, drawer type tool boxes are developed and includes multiple drawers each may receive tools and accessories. Nevertheless, the drawers have to pulled out one by one and the lower one is hide by the upper one so that the user cannot see the tools in the lower drawer.

The present invention intends to provide a tool box that includes multiple boxes which can be expanded simultaneously so that the users may see clearly the contents in the boxes.

SUMMARY OF THE INVENTION

In accordance with one aspect of the present invention, there is provided a tool box which comprises a base with an open top and two sets of boxes are located symmetrically above the base. Each set of boxes includes two boxes and each box has an open top. A cover is pivotably connected to the open top of each of the top most boxes of the two sets of boxes. Two sets of links are respectively connected to one side of the base and the two sets of boxes. Each set of links includes a long link and two short links which are located on two sides of the long link. The long link is pivotably connected to the base and the two boxes at three pivot points. One of the short links is pivotably connected between the base and the box rested on the base. The other short link is pivotably connected between the two boxes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
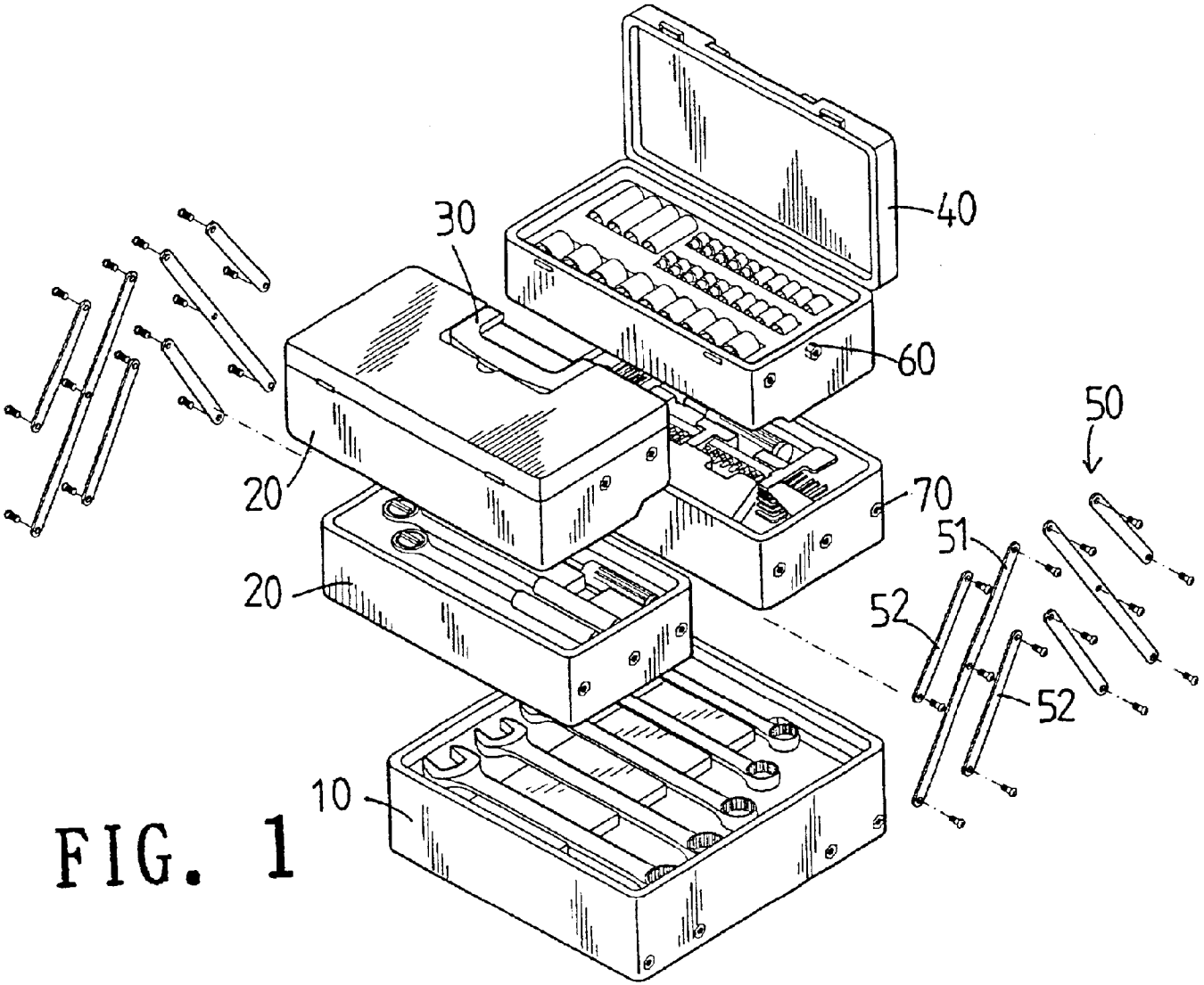
FIG. 1 is an exploded view to show a tool box of the present invention.
Figures 2, 3:
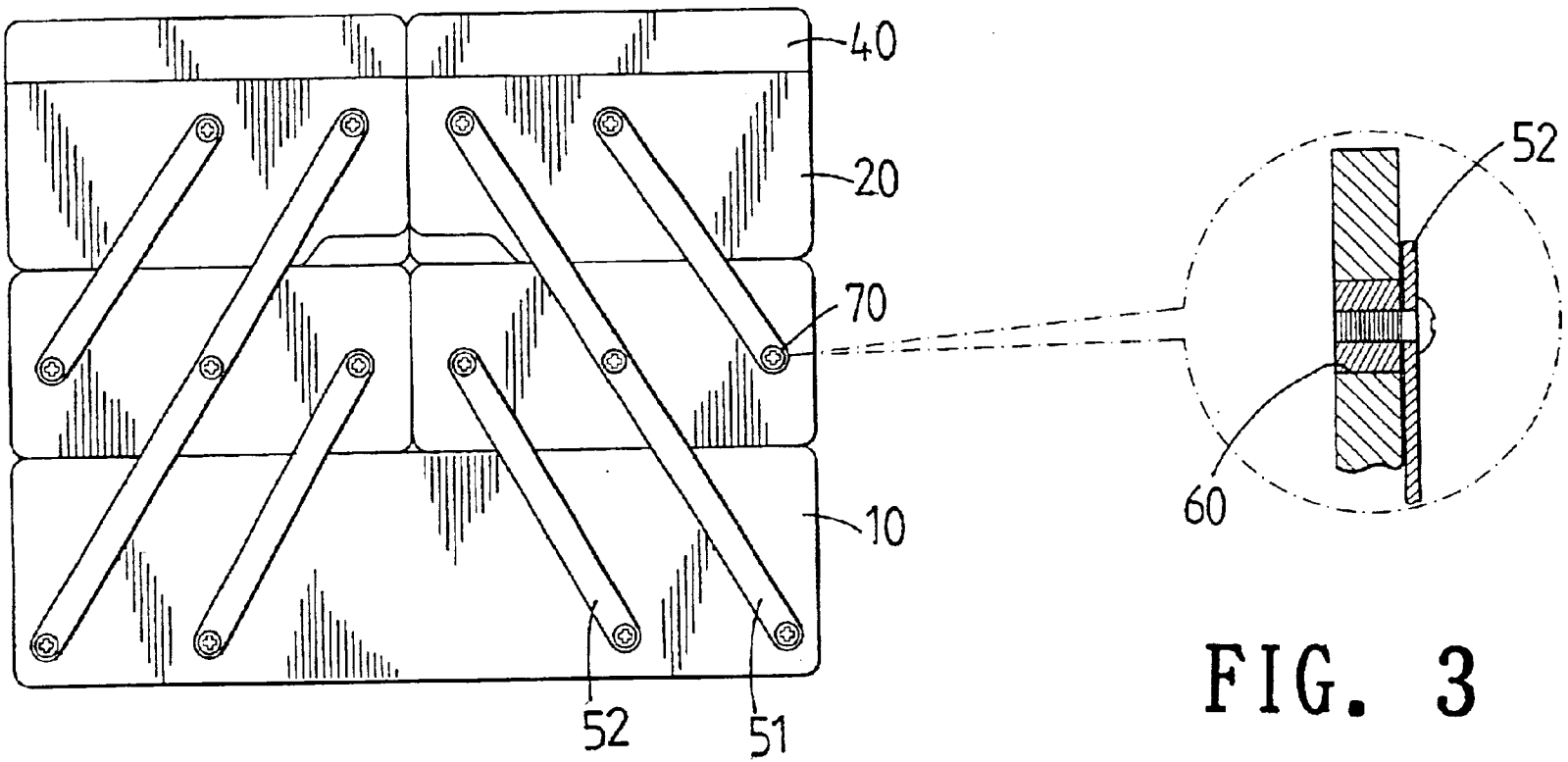
FIG. 2 is a side view to show the tool box.
FIG. 3 is a cross sectional view to show the bolt extends through the link and is engaged with a nut in the box.

Referring to FIGS. 1 to 3, the tool box of the present invention comprises a base 10 with an open top so as to receive tools and accessories therein, and two sets of boxes are located symmetrically above the base 10. Each set of boxes includes two boxes and each box 20 has an open top. A cover 40 is pivotably connected to the open top of each of the top most boxes 20 of the two sets of boxes. A handle 30 is connected to each of the covers 40.

Two sets of links 50 are respectively connected to one side of the base 10 and the two sets of boxes. Each set of links 50 includes a long link 51 and two short links 52 which are located on two sides of the long link 51. The long link 51 is pivotably connected to the base and the two boxes 20 at three pivot points. One of the short links 52 is pivotably connected between the base 10 and the box 20 rested on the base 10, and the other short link 52 is pivotably connected between the two boxes 20.

Each of the base 10 and the boxes 20 has proper number of sink holes in a wall thereof each of the sink holes has a nut 70 embedded therein. Bolts extends through the links 51/52 and are connected to the nuts 70 respectively.

Figure 4:
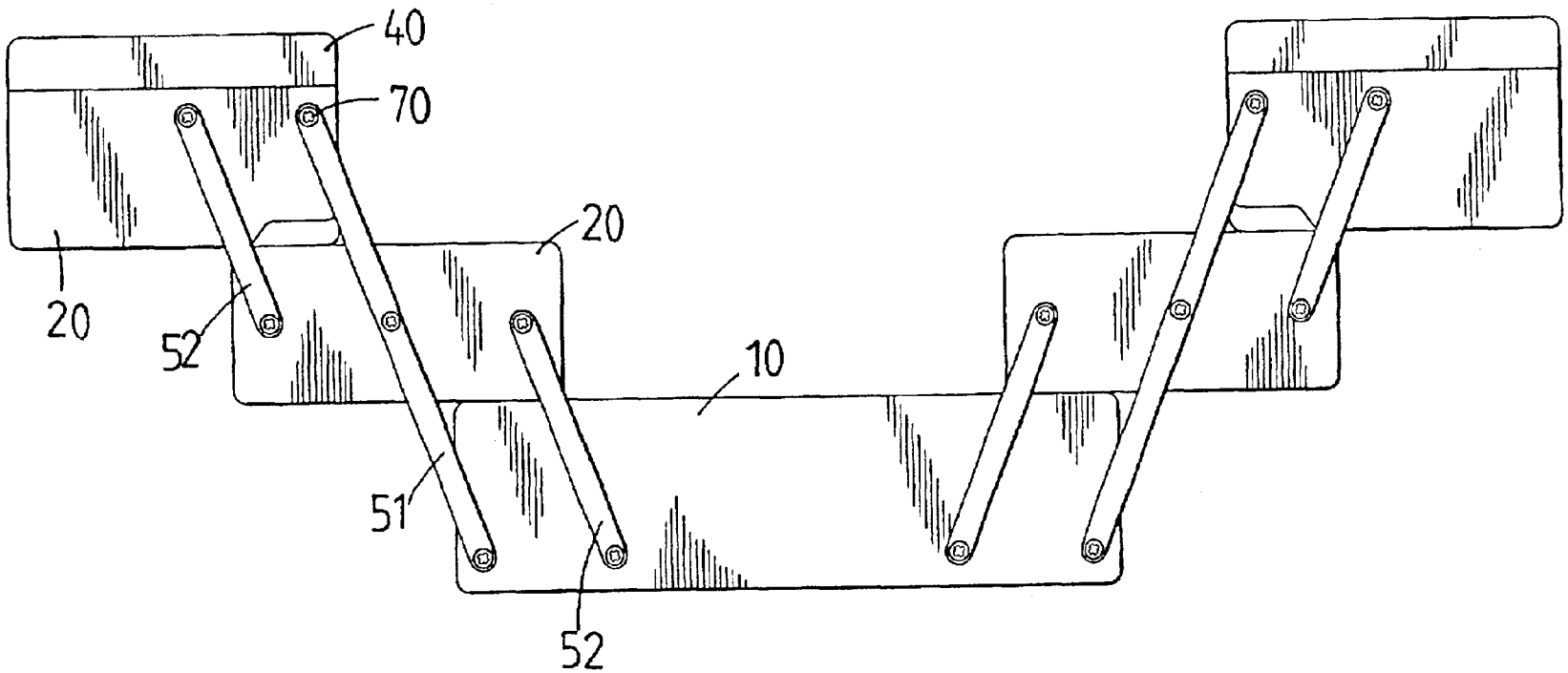
FIG. 4 shows the tool box is opened and the boxes are expanded.
Figure 5:
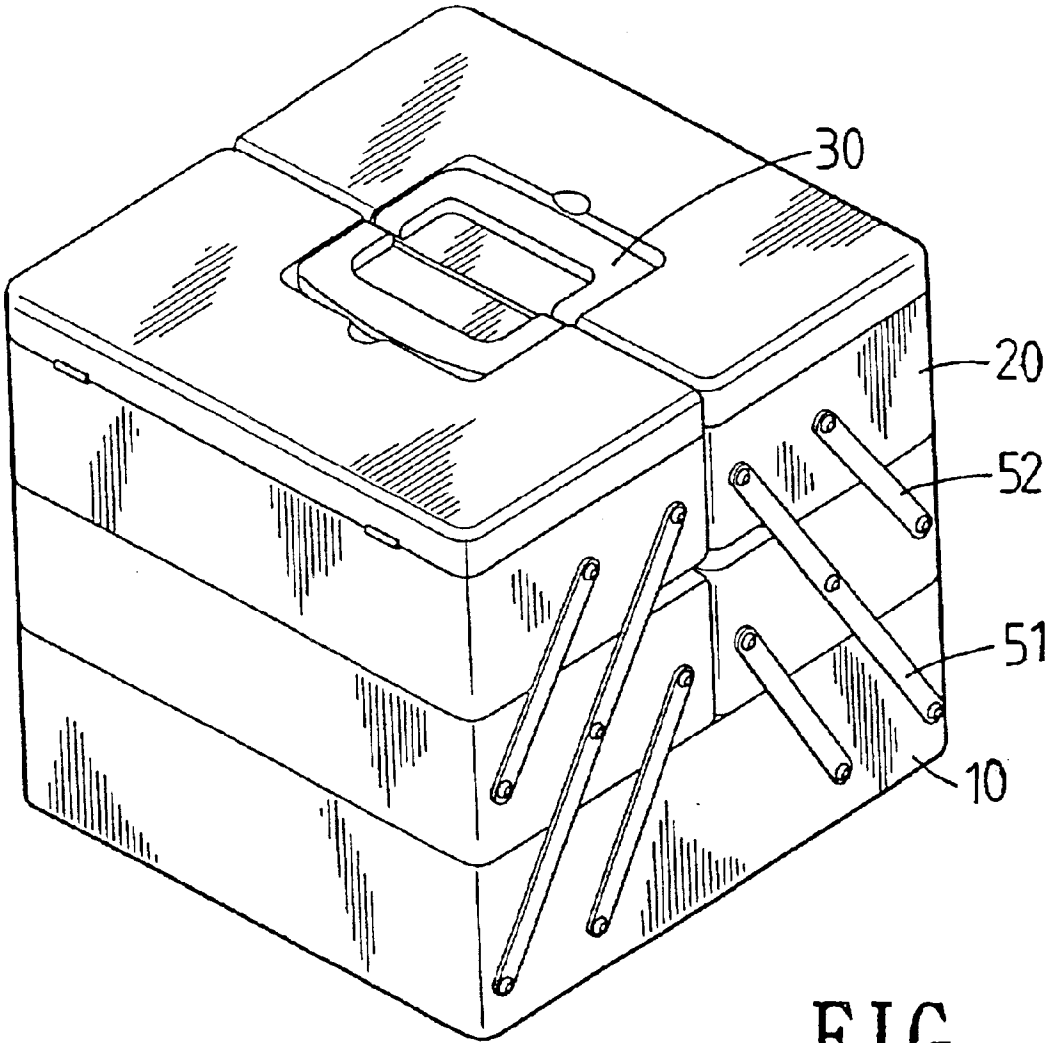
FIG. 5 shows the tool box is in a close status.
Figure 6:
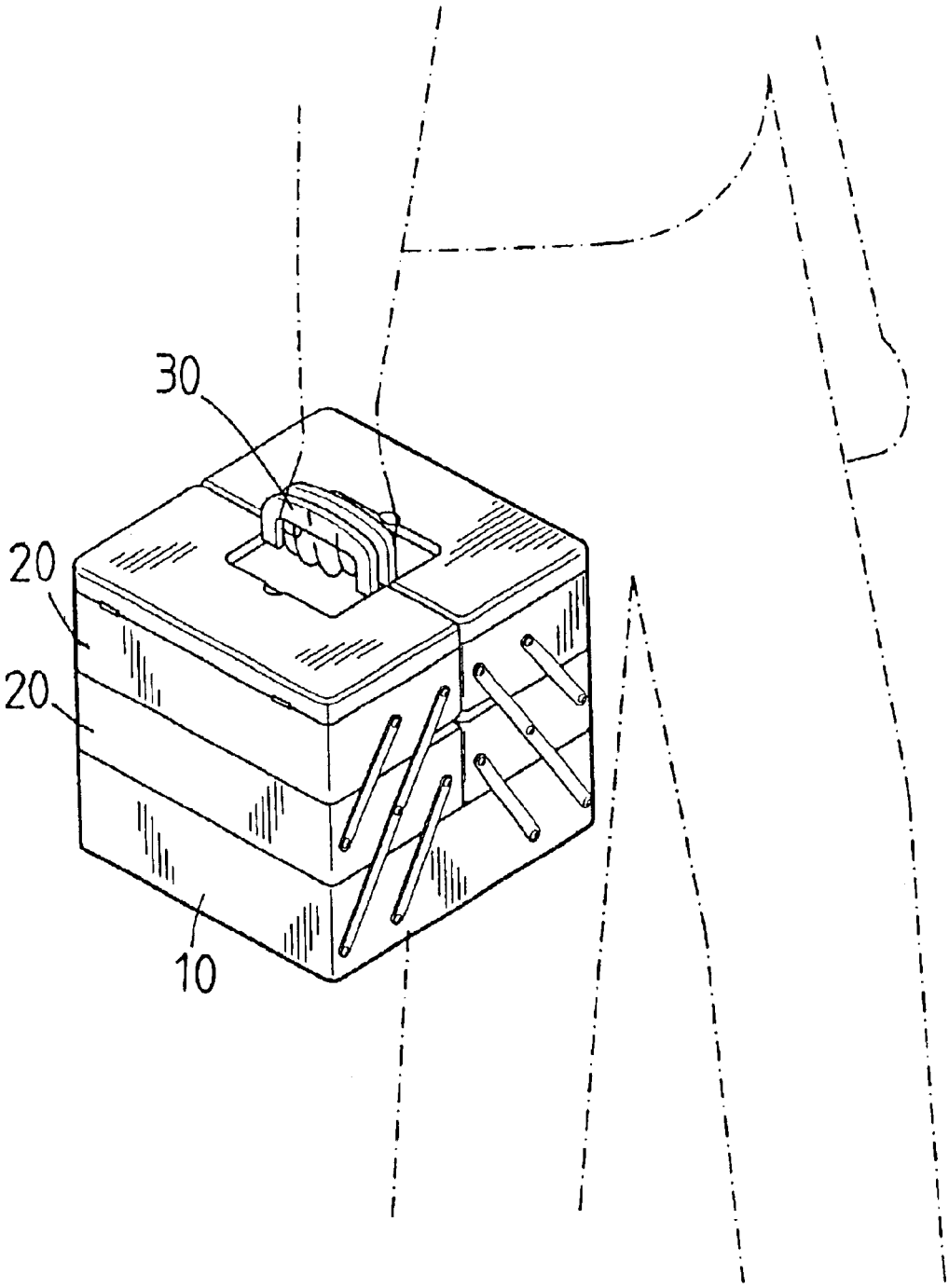
FIG. 6 shows the tool box is carries by a user.

As shown in FIG. 4, when the two sets of the boxes are pulled outward, the boxes 20 are expanded outward by the links 51, 52 in stepped fashion so that the user can see the contents in each of the boxes 20. As shown in FIGS. 5 and 6, when the tool box is in a closed status, the user may conveniently carry the tool box by the handles 30.

While we have shown and described the embodiment in accordance with the present invention, it should be clear to those skilled in the art that further embodiments may be made without departing from the scope of the present invention.

What is claimed is:

1. A tool box comprising:

a base with an open top;

two sets of boxes located symmetrically above the base and each set of boxes includes two boxes, each box having an open top, a cover pivotably connected to the open top of each of the top most boxes of the two sets of boxes, each cover having a handle and the handles being held together to carry the too box, and two sets of links respectively connected to one side of the base and the two sets of boxes, each set of links including a long link and two short links which are located on two sides of the long link, the long link pivotably connected to the base and the two boxes at three pivot points, one of the short links pivotably connected between the base and the box rested on the base, and the other short link pivotably connected between the two boxes.

2. The tool box as claimed in claim 1, wherein each of the base and the boxes has at least one nut embedded in a wall so that at least one bolt extends through the link and is connected to the at least one nut.

* * * * *